US005446459A

United States Patent [19]

Kim et al.

[11] Patent Number: 5,446,459

[45] Date of Patent: Aug. 29, 1995

[54] WIDE BAND TYPE ELECTROMAGNETIC WAVE ABSORBER

[75] Inventors: Kyung Y. Kim, Seoul; Wang S. Kim, Kyungki; Hyung J. Jung, Seoul; Yoon D. Ju, Kyungsangnam, all of Rep. of Korea

[73] Assignee: Korea Institute of Science and Technology, Seoul, Rep. of Korea

[21] Appl. No.: 225,754

[22] Filed: Apr. 11, 1994

Related U.S. Application Data

[63] Continuation-in-part of Ser. No. 915,058, Jul. 16, 1992, abandoned.

[30] Foreign Application Priority Data

Aug. 13, 1991 [KR] Rep. of Korea ..... 13922

[51] Int. Cl.[6] ..... H01Q 17/00

[52] U.S. Cl. ..... 342/1; 342/4

[58] Field of Search ..... 342/1, 2, 3, 4

[56] References Cited

U.S. PATENT DOCUMENTS

| | | | |
|---|---|---|---|
| 3,720,951 | 3/1973 | Naito | 342/1 |
| 3,754,255 | 8/1973 | Suetake et al. | 342/4 |
| 3,855,691 | 12/1974 | Deschamps et al. | 29/608 |
| 3,887,920 | 6/1975 | Wright et al. | 342/1 |
| 3,938,152 | 2/1976 | Grimes et al. | 342/1 |
| 4,023,174 | 5/1977 | Wright | 342/4 |
| 4,024,318 | 5/1977 | Forster et al. | 342/1 X |
| 4,118,704 | 10/1978 | Ishino et al. | 342/4 |
| 4,531,110 | 7/1985 | Johnson, Jr. et al. | 29/612 |
| 4,725,490 | 2/1988 | Goldberg | 342/1 X |
| 4,728,554 | 3/1988 | Goldberg et al. | 342/1 X |
| 4,952,935 | 8/1990 | Sawa et al. | 342/4 |
| 5,093,100 | 3/1992 | Sadamura et al. | 342/1 X |
| 5,120,366 | 6/1992 | Harada et al. | 106/486 |
| 5,134,039 | 7/1992 | Alexander et al. | 428/614 |
| 5,323,160 | 6/1994 | Kim et al. | 342/1 |
| 5,326,633 | 7/1994 | Clough et al. | 428/288 |
| 5,385,623 | 1/1995 | Diaz | 156/197 |

FOREIGN PATENT DOCUMENTS

| | | |
|---|---|---|
| 54-275577 | 9/1979 | Japan . |
| 55-5720 | 2/1980 | Japan . |
| 64-1298 | 1/1989 | Japan . |

OTHER PUBLICATIONS

K. Ishino et al., "Development of Magnetic Ferrites: Control and Application of Losses"; *Amer. Ceram. Soc. Bull.*, vol. 66 (10), pp. 1469–1474 (1987).

*Primary Examiner*—John B. Sotomayor

*Attorney, Agent, or Firm*—Scully, Scott, Murphy & Presser

[57] ABSTRACT

This invention relates to a broad bandwidth electromagnetic wave absorber comprising a sintered ferrite and a CuO—$Fe_2O_3$ system. The CuO—$Fe_2O_3$ system, a spinel ferrite, has its own magnetic property, which makes it possible to be used for an electromagnetic wave absorber. The CuO—$Fe_2O_3$ system is preferentially located at the grain boundary in the matrix ferrite. This resulted in increase in the total loss, decrease in matching thickness and shift in the center frequency.

7 Claims, 3 Drawing Sheets

WIDE BAND TYPE ELECTROMAGNETIC WAVE ABSORBER

RELATED APPLICATIONS

This application is a continuation-in-part of U.S. Ser. No. 915,058 filed on Jul. 16, 1992, abandoned.

BACKGROUND OF THE INVENTION

The present invention relates, to electromagnetic wave absorbers made of magnetic ferrite materials and to a method of preparing the same. More specifically, the present invention relates to electromagnetic wave absorbers comprising a sintered ferrite material and a CuO—$Fe_2O_3$ spinel-structured material, wherein the amount of CuO present in the CuO—$Fe_2O_3$ spinel-structured material is from about 40 to about 60 mol % based on the total amount of CuO—$Fe_2O_3$ material.

BACKGROUND OF THE PRIOR ART

As modern information-oriented societies advance and diversify with rapid development of information and communication technology, many attempts for prevention of interference by unwanted electromagnetic waves have been initiated to increase reliability in the use of electromagnetic waves. Television waves complexly reflected by tall buildings often cause "ghost" phenomenon on TV sets in wide viewing areas. Unwanted electromagnetic waves of external sources frequently cause malfunction of electronic installations and mechanical machineries equipped with electronic devices. As a solution, improvement of wave transmission and reception methods have been considered. However, the fundamental solution is to eliminate the reflection itself by absorbing incoming waves. This would mean cladding outer walls of the building with wave absorbing materials.

One of the best known electromagnetic wave absorbers is a magnetic material such as ferrite. The magnetic loss of ferrites, transformation of electromagnetic waves into heat, prevents waves from reflecting.

For practical use, magnetic materials are required to exhibit wave absorbing properties in the wide frequency ranges and can be formed into thin plates. Since magnetic resonance phenomenon of ferrites is essentially utilized for wave absorption, effective frequency ranges of ferrites as wave absorbers are very limited (T. Inui, et al., "Electromagnetic Wave Absorber; Application of Ferrite By-Product," NEC Bulletin, vol. 37(9), pp. 2 (1984)). To overcome this limitation, lamination of two different ferrites has been attempted (Japan Patent Laid-open Publication No. 64-1298), but the shortcoming was a large total thickness of more than 10 mm. Another effort to broaden the frequency ranges is to form a mixture of two ferrites and a dielectric material (U.S. Pat. No. 3,754,255). In this case, the dielectric materials present at the grain boundaries tend to enhance insulating property of ferrites and consequently suppress eddy current loss. As a result, thin plate formation was unattainable.

SUMMARY OF THE INVENTION

It is, therefore, an object of the present invention to provide an electromagnetic wave absorber which is capable of obtaining a broadened frequency range and a thin plate formation.

In the present invention, a spinel-structured material of different magnetic properties from the sintered ferrite is added to the wave absorbing sintered ferrite as a liquid forming agent to overcome the above-mentioned limitations. Specifically, the electromagnetic wave absorbers of the present invention comprise a sintered wave absorbing ferrite material having a CuO—$Fe_2O_3$ spinel-structured material present at the grain boundaries of the sintered ferrite material, said spinel-structured material containing from about 40 to 60 mol % CuO and having different magnetic properties from the sintered ferrite material.

The present invention further relates to a method of preparing the aforementioned electromagnetic wave absorbers. Specifically, the method of the instant invention comprises the steps of (a) calcining a ferrite wave absorbing material; (b) mixing said calcined wave absorbing material with a CuO—$Fe_2O_3$ spinel-structured material containing from about 40 to about 60 mol % CuO based on the total amount of CuO—$Fe_2O_3$; and (c) sintering said mixture under conditions effective to cause said CuO—$Fe_2O_3$ spinel-structured material to be distributed along the grain boundaries of said wave-absorbing ferrite material.

BRIEF DESCRIPTION OF THE DRAWINGS

FIG. 2 illustrates the attenuation behaviors of a monolithic ferrite and a CuO—$Fe_2O_3$ system, in which:

1; sintered monolithic ferrite

2; sintered body of CuO 40 mol %-$Fe_2O_3$ 60 mol %

3; sintered body of CuO 45 mol %-$Fe_2O_3$ 55 mol %

4; sintered body of CuO 50 mol %-$Fe_2O_3$ 50 mol %

Figure 3:
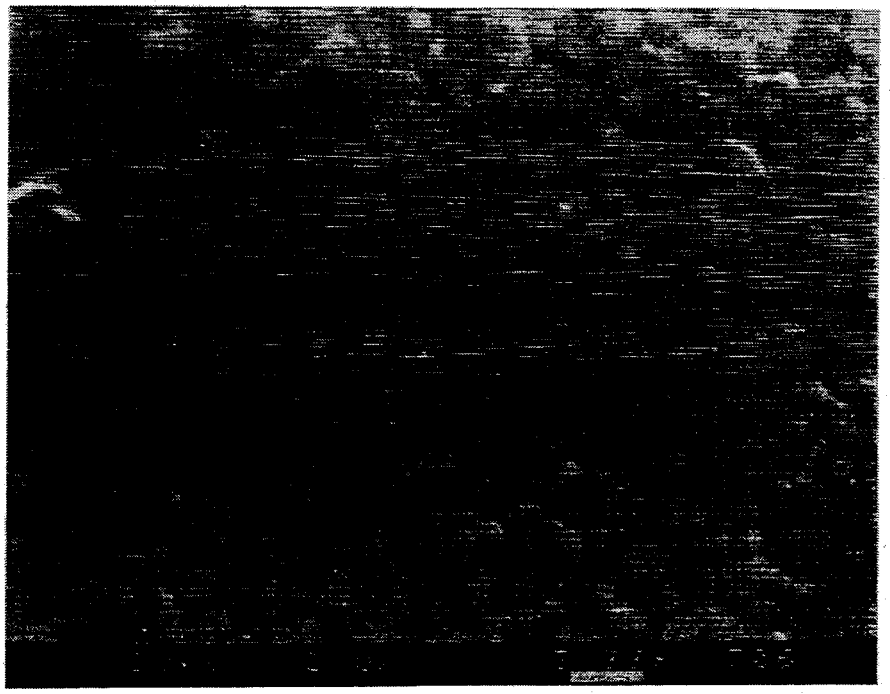

FIG. 3 is a SEM photograph of a sintered ferrite containing 1 wt % of CuO 50 mol %-$Fe_2O_3$ 50 mol %.

DESCRIPTION OF THE INVENTION

The spinel materials employed in the present invention are the CuO—$Fe_2O_3$ system, which melts into liquid phase at 1100°~1150° C. lower than the ferrite sintering temperature of 1200°~1500° C. The ferrite material employed in the instant invention is further characterized in that CuO is present in an amount of about 40 to 60 mol % based on the total amount of CuO—$Fe_2O_3$.

Figure 1:
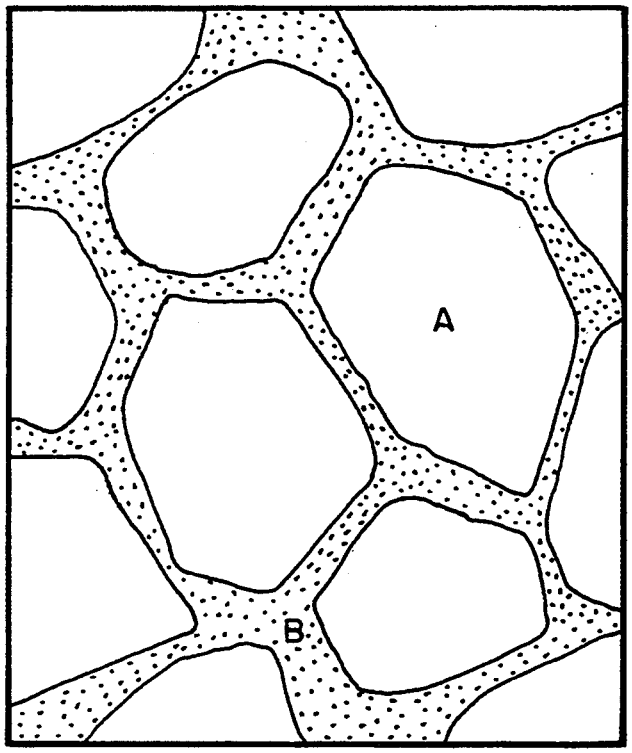
FIG. 1 is a schematic representation of sintered microstructure, where CuO—$Fe_2O_3$ liquid phase is present at the grain boundaries of a matrix ferrite (A; matrix ferrite, B; CuO—$Fe_2O_3$ liquid phase).
Figure 2:
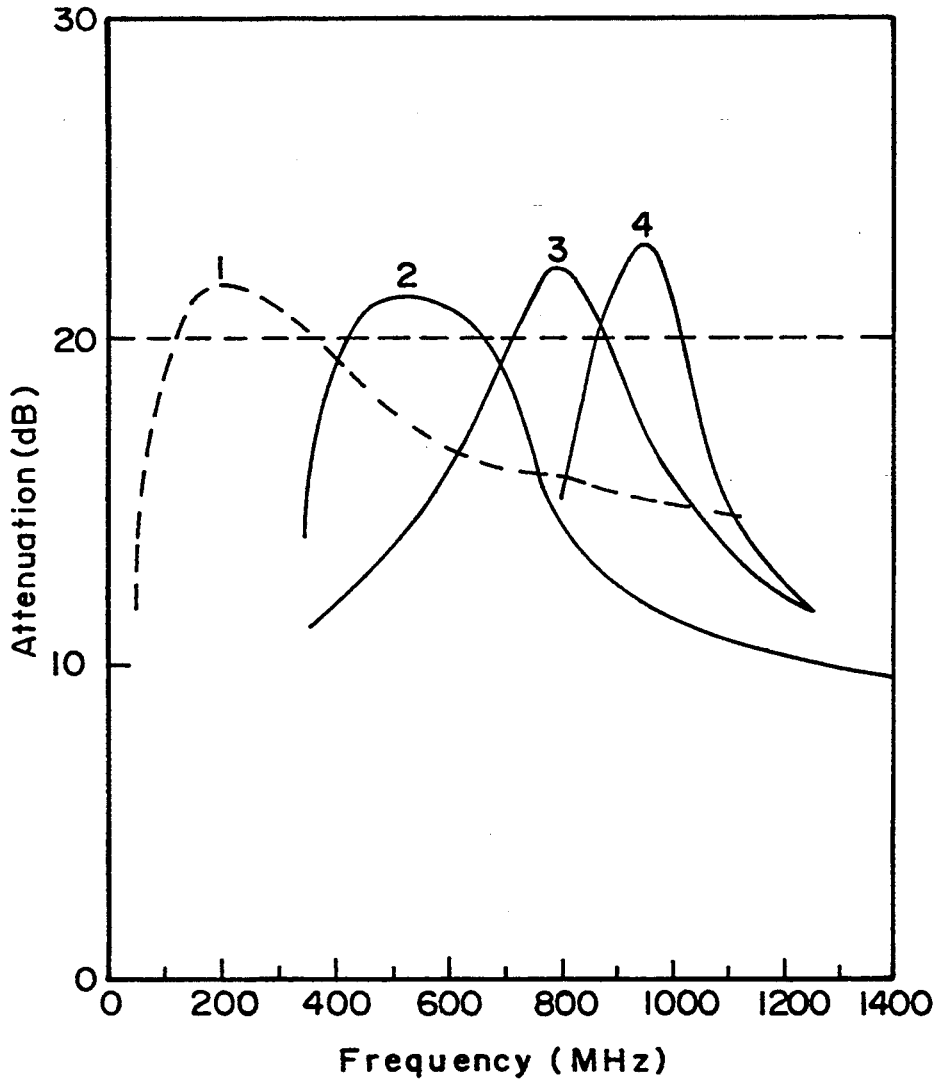

The melted CuO—$Fe_2O_3$ system forms such microstructure shown in FIG. 1 and FIG. 3. FIG. 2 illustrates the wave absorbing characteristics of a CuO—$Fe_2O_3$ system. Differing from other dielectric liquid phases, CuO—$Fe_2O_3$ liquid phase present at the grain boundaries is itself a ferrite having wave absorbing properties, but exhibits the imaginary part of the complex permittivity in the range of 2~3, in contrast to almost zero for common ferrites. Large values of the imaginary part, $\epsilon''$, mean high electrical conductivity, as can be expressed by the equation $$\epsilon''=\sigma/\omega,$$

where $\sigma$ and $\omega$ represent electrical conductivity and frequency, respectively.

When a phase with a high electrical conductivity and different magnetic characteristics from those of sintered ferrites exists at the grain boundaries, the following effects are expected. As previously reported (K. Ishino, et al., "Development of Magnetic Ferrites: Control and Application of Losses," Am. Ceram. Soc. Bull. vol. 66(10), pp. 1469 (1987)), compositional inhomogeneity in the sintered ferrites increases the total loss due to eddy current loss. Because this loss increases with increasing electrical conductivity of grain boundaries, the present invention can provide two advantageous effects simultaneously. That is, when a CuO—$Fe_2O_3$ system and a ferrite which exhibit wave absorption characteristics at different frequency ranges are selected, broadened bandwidth combining two frequency ranges can be obtained. At the same time, the increased total loss allows thinner wave absorbing plates to be used.

Differing from other methods, the present invention can also provide more uniform microstructures, compared to those of common composites made by mixing two ferrite powders. The maximized homogeneity in microstructure can be explained by the fact that CuO—$Fe_2O_3$ liquid phase formed at the sintering stage are uniformly distributed along grain boundaries.

The CuO of the spinel-structured material, CuO—$Fe_2O_3$, should be used in the amount of 40 to 60 mol % based on the total amount of CuO—$Fe_2O_3$. The liquid phase of the spinel system is separated into CuO and spinel solid solution under chilling. Therefore, when the amount of CuO is below 40 mol %, the magnetic property of the liquid phase is deteriorated, while sintering is promoted due to the lowered melting point. On the other hand, when CuO is used in an amount exceeding 60 mol %, the melting point is raised and thus, sintering cannot be sufficiently effected (Comparative Example 1). Also, this spinel-structured material should be added after the matrix ferrite is calcined. If the spinel material is mixed first with the matrix ferrite, and then calcined and then sintered, CuO—$Fe_2O_3$ would not exist at the grain boundary but would be dispersed into the lattice of the matrix ferrite to form homogeneous Cu—Ni—Zn ferrite (Comparative Example 2). Further, if the sintering temperature exceeds 1250° C. or the sintering time exceeds two hours, the spinel-structured material reacts with the matrix ferrite to form a homogeneous composition, which in turn makes it impossible to obtain the desired effect of the present invention.

The following examples are offered by way of illustration and not by way of limitation.

EXAMPLE 1

$Ni_{0.6}Zn_{0.4}Fe_2O_4$ ferrite calcined at 900° C. was mixed with CuO—$Fe_2O_3$ system at several different weight ratios and then ball milled. The dried powder mixture was then pressed into a coaxial specimen with outer and inner diameters of 7 and 3 mm, followed by sintering at 1200° C. for 1 hr. Complex permittivity and attenuation characteristics were measured by a network analyzer (HP 8510A) and coaxial measuring equipment (HP 85051-60007). The experimental results for this example are listed in Table 1. Compared to a monolithic ferrite, a sintered ferrite containing CuO—$Fe_2O_3$ showed a larger value of the imaginary part of the complex permittivity, a smaller matching thickness, and broader frequency ranges wherein 20 dB loss or more can be accomplished.

TABLE 1

| | | Results of example | | | |
|---|---|---|---|---|---|
| CuO | $Fe_2O_3$ | Amount of Additive | $\mu''$ (at 50 MHz | Matching Thickness (mm) | Effective Frequency Range |
| 40 | 60 | 1 wt % | 123 | 7.0 | 113~725 MHz |

TABLE 1-continued

| | | Results of example | | | |
|---|---|---|---|---|---|
| CuO | $Fe_2O_3$ | Amount of Additive | $\mu''$ (at 50 MHz | Matching Thickness (mm) | Effective Frequency Range |
| | | 3 | 115 | 7.3 | 130~800 |
| | | 5 | 127 | 6.5 | 141~800 |
| 45 | 55 | 1 | 122 | 7.2 | 98~683 |
| | | 3 | 128 | 6.7 | 98~800 |
| | | 5 | 124 | 6.8 | 137~875 |
| 50 | 50 | 1 | 118 | 7.4 | 106~725 |
| | | 3 | 120 | 7.2 | 122~875 |
| | | 5 | 129 | 6.4 | 148~875 |
| 55 | 45 | 1 | 119 | 7.3 | 110~762 |
| | | 3 | 126 | 6.7 | 143~800 |
| | | 5 | 117 | 7.0 | 151~950 |
| 60 | 40 | 1 | 123 | 7.0 | 118~800 |
| | | 3 | 125 | 6.8 | 125~821 |
| | | 5 | 132 | 6.1 | 149~830 |
| Monolithic ferrite | | | 65 | 11.7 | 139~530 |

Comparative Example 1

A Ni—Zn ferrite having the same composition as that of Example 1 was calcined at 900° C. and mixed with CuO—$Fe_2O_3$ system at different weight ratios wherein CuO is contained in the amount of 35 mol % and 65 mol %, respectively. Experimental results are listed in Table 2. Compared to the sintered ferrite with CuO—$Fe_2O_3$ according to Example 1, these comparative ferrites do not exhibit desired effect of CuO—$Fe_2O_3$ addition.

TABLE 2

| | | Results of Comparative Experiment 1 | | | |
|---|---|---|---|---|---|
| CuO | $Fe_2O_3$ | Amount of Additive (wt %) | $\mu''$ (at 50 MHz) | Matching Thickness (mm) | Effective Frequency Range(MHz) |
| 65 | 35 | 1 | 66 | 11.6 | 140~530 |
| | | 3 | 67 | 11.4 | 130~535 |
| | | 5 | 69 | 11.0 | 130~535 |
| 35 | 65 | 1 | 85 | 10.0 | 125~500 |
| | | 3 | 88 | 10.2 | 125~520 |
| | | 5 | 89 | 11.0 | 130~510 |

Comparative Example 2

The Ni—Zn ferrite of Example 1 was mixed with CuO—$Fe_2O_3$ system at several different weight ratios and then calcined. The mixture was sintered as in Example 1. Experimental results are listed in Table 3. Compared to the results of Example 1, these comparative ferrites do not exhibit desired effects of CuO—$Fe_2O_3$ addition.

TABLE 3

| | | Results of Comparative Experiment 2 | | | |
|---|---|---|---|---|---|
| CuO | $Fe_2O_3$ | Amount of Additive (wt %) | $\mu''$ (at 50 MHz) | Matching Thickness (mm) | Effective Frequency Range(MHz) |
| 40 | 60 | 1 | 64 | 11.7 | 137~530 |
| | | 3 | 65 | 11.7 | 138~520 |
| | | 5 | 64 | 11.6 | 130~530 |
| 45 | 55 | 1 | 64 | 11.7 | 129~500 |
| | | 3 | 63 | 11.6 | 132~530 |
| | | 5 | 63 | 11.7 | 135~515 |
| 50 | 50 | 1 | 62 | 11.5 | 129~525 |
| | | 3 | 62 | 11.7 | 130~515 |
| | | 5 | 61 | 11.9 | 141~580 |
| 55 | 45 | 1 | 62 | 12.0 | 139~600 |
| | | 3 | 62 | 12.0 | 132~560 |
| | | 5 | 61 | 12.1 | 125~500 |
| 60 | 40 | 1 | 60 | 12.3 | 127~520 |
| | | 3 | 61 | 12.4 | 120~580 |

TABLE 3-continued

| | | Results of Comparative Experiment 2 | | | |
|---|---|---|---|---|---|
| CuO | $Fe_2O_3$ | Amount of Additive (wt %) | μ'' (at 50 MHz) | Matching Thickness (mm) | Effective Frequency Range(MHz) |
| | | 5 | 61 | 12.7 | 132~550 |

Comparative Example 3

The Ni—Zn ferrite of Example 1 was calcined at 900° C. and mixed with 3 wt. % of CuO—$Fe_2O_3$ system (CuO 50 mol %; $Fe_2O_3$ 50 mol %) and then calcined at 1250° C. for 1 hour and at 1200° C. for 2 hours, respectively. Experimental results are listed in Table 4. Compared to the results of Example 1, these comparative ferrites do not exhibit the desired effect of CuO—$Fe_2O_3$ addition.

TABLE 4

| Results of Comparative Example 3 | | | | |
|---|---|---|---|---|
| Sintering Condition | | μ'' (at 50 | Matching Thickness | Effective Frequency |
| Temp (°C.) | Time (hr) | MHz) | (mm) | Range(MHz) |
| 1250 | 1 | 63 | 11.8 | 133~531 |
| 1200 | 2 | 62 | 11.9 | 128~510 |

The above embodiments and examples are given to illustrate the scope and spirit of the present invention. These embodiments and examples will make apparent, to those skilled in the art, other embodiments and examples. These other embodiments and examples are within the scope of the present invention. Therefore, the present invention should be limited only by the appended claims.

What is claimed is:

1. An electromagnetic wave absorber for use in broad frequency ranges comprising a sintered wave absorbing ferrite material having a CuO—$Fe_2O_3$ spinal-structured material present at the grain boundaries of the sintered ferrite material, wherein said spinal-structured material contains from about 40 to about 60 mol % CuO based on the total amount of CuO—$Fe_2O_3$ and having different magnetic properties from the sintered ferrite material.

2. The electromagnetic wave absorber of claim 1 wherein said CuO—$Fe_2O_3$ spinel-structured material is a liquid at or below the sintering temperature of the wave absorbing ferrite material.

3. The electromagnetic wave absorber of claim 1 wherein said CuO—$Fe_2O_3$ spinel-structured material is composed of CuO and $Fe_2O_3$ which are added in the form of (i) oxide, or (ii) salts or compounds that transform into oxides during calcination or sintering.

4. A method of preparing an electromagnetic wave absorber for use in broad frequency ranges comprising:

(a) calcining a ferrite wave absorbing material;

(b) mixing said calcined wave absorbing material with a CuO—$Fe_2O_3$ spinel-structured material containing from about 40 to about 60 mol% CuO; and (c) sintering said mixture formed in step (b) under conditions effective to cause said CuO—$Fe_2O_3$ spinel-structured material to be distributed along the grain boundaries of said ferrite wave absorbing material.

5. The method of claim 4 wherein said CuO—$Fe_2O_3$ spinel-structured material is added in an amount from about 1 to about 5 wt. %.

6. The method of claim 4 wherein said mixture is sintered at a temperature not greater than 1250° C. for a period of time not greater than 2 hrs.

7. The method of claim 4 wherein said CuO—$Fe_2O_3$ spinel-structured material is a liquid at or below the sintering temperature of said wave absorbing ferrite material.

* * * * *

UNITED STATES PATENT AND TRADEMARK OFFICE

CERTIFICATE OF CORRECTION

PATENT NO. : 5,446,459

DATED : August 29, 1995

INVENTOR(S) : Kyung Yong Kim, et al.

It is certified that error appears in the above-indentified patent and that said Letters Patent is hereby corrected as shown below:

Column 1, line 10: after "relates" delete --,--

Column 3, line 50: "ball milled" should read --ball-milled--

Column 5, line 38, Claim 1: "spinal-structured" should read --spinel-structured--

Column 6, line 2, Claim 1: "spinal-structured" should read --spinel-structured--

Signed and Sealed this

Twenty-fifth Day of June, 1996

Bruce Lehman

*Attest:*

BRUCE LEHMAN

*Attesting Officer*

*Commissioner of Patents and Trademarks*